US005972208A

United States Patent [19]

Goolsby et al.

[11] Patent Number: 5,972,208

[45] Date of Patent: Oct. 26, 1999

[54] FCC METALS PASSIVATION ADDITIVES APPLIED TO CATALYST

[75] Inventors: Terry L. Goolsby, Katy, Tex.; Dennis C. Kowalczyk, Gibsonia, Pa.; Howard F. Moore, Catlettsburg, Ky.

[73] Assignee: The M. W. Kellogg Company, Houston, Tex.

[21] Appl. No.: 09/112,622

[22] Filed: Jul. 9, 1998

Related U.S. Application Data

[60] Provisional application No. 60/052,335, Jul. 11, 1997.

[51] Int. Cl.[6] ..... C10G 11/00

[52] U.S. Cl. ..... 208/152; 208/113; 502/52

[58] Field of Search ..... 208/113, 152; 502/52

[56] References Cited

U.S. PATENT DOCUMENTS

| | | | |
|---|---|---|---|
| Re. 31,439 | 11/1983 | Rosensweig . | |
| Re. 35,046 | 10/1995 | Hettinger, Jr. et al. . | |
| 3,711,422 | 1/1973 | Johnson et al. . | |
| 4,359,379 | 11/1982 | Ushio et al. . | |
| 4,406,773 | 9/1983 | Hettinger, Jr. et al. . | |
| 4,459,366 | 7/1984 | Mark et al. | 502/25 |
| 4,466,884 | 8/1984 | Occelli et al. | 208/120 |
| 4,482,450 | 11/1984 | Ushio et al. . | |
| 4,562,167 | 12/1985 | Bertus et al. | 502/100 |
| 4,727,823 | 3/1988 | Thompson et al. . | |
| 4,823,102 | 4/1989 | Cherian et al. . | |
| 4,882,043 | 11/1989 | Jung . | |
| 4,935,121 | 6/1990 | Fu et al. | 208/102 |
| 5,147,527 | 9/1992 | Hettinger . | |
| 5,171,424 | 12/1992 | Hettinger . | |
| 5,190,635 | 3/1993 | Hettinger . | |
| 5,198,098 | 3/1993 | Hettinger, Jr. . | |
| 5,230,869 | 7/1993 | Hettinger et al. . | |
| 5,250,482 | 10/1993 | Doctor . | |
| 5,328,594 | 7/1994 | Hettinger . | |
| 5,364,827 | 11/1994 | Hettinger et al. . | |
| 5,393,412 | 2/1995 | Hettinger . | |
| 5,448,803 | 9/1995 | Morell . | |
| 5,538,624 | 7/1996 | Hettinger . | |

OTHER PUBLICATIONS

Magnet Terminology Glossary, Magnet Sales and Manufacturing, Inc.

*Primary Examiner*—Walter D. Griffin
*Assistant Examiner*—Tam M. Nguyen
*Attorney, Agent, or Firm*—The M. W. Kellogg Co.

[57] ABSTRACT

A process and apparatus for incorporating additives into a circulating inventory of equilibrium catalyst in a fluid catalyst cracking (FCC) unit are disclosed. Hot regenerated catalyst is removed from the FCC regenerator, cooled, optionally subjected to magnetic catalyst separation, and at least a portion of the cooled catalyst is contacted with a solution of an additive material without forming a separated liquid phase. Additive treated catalyst is recycled to the FCC unit, preferably directly into the regenerator.

9 Claims, 1 Drawing Sheet

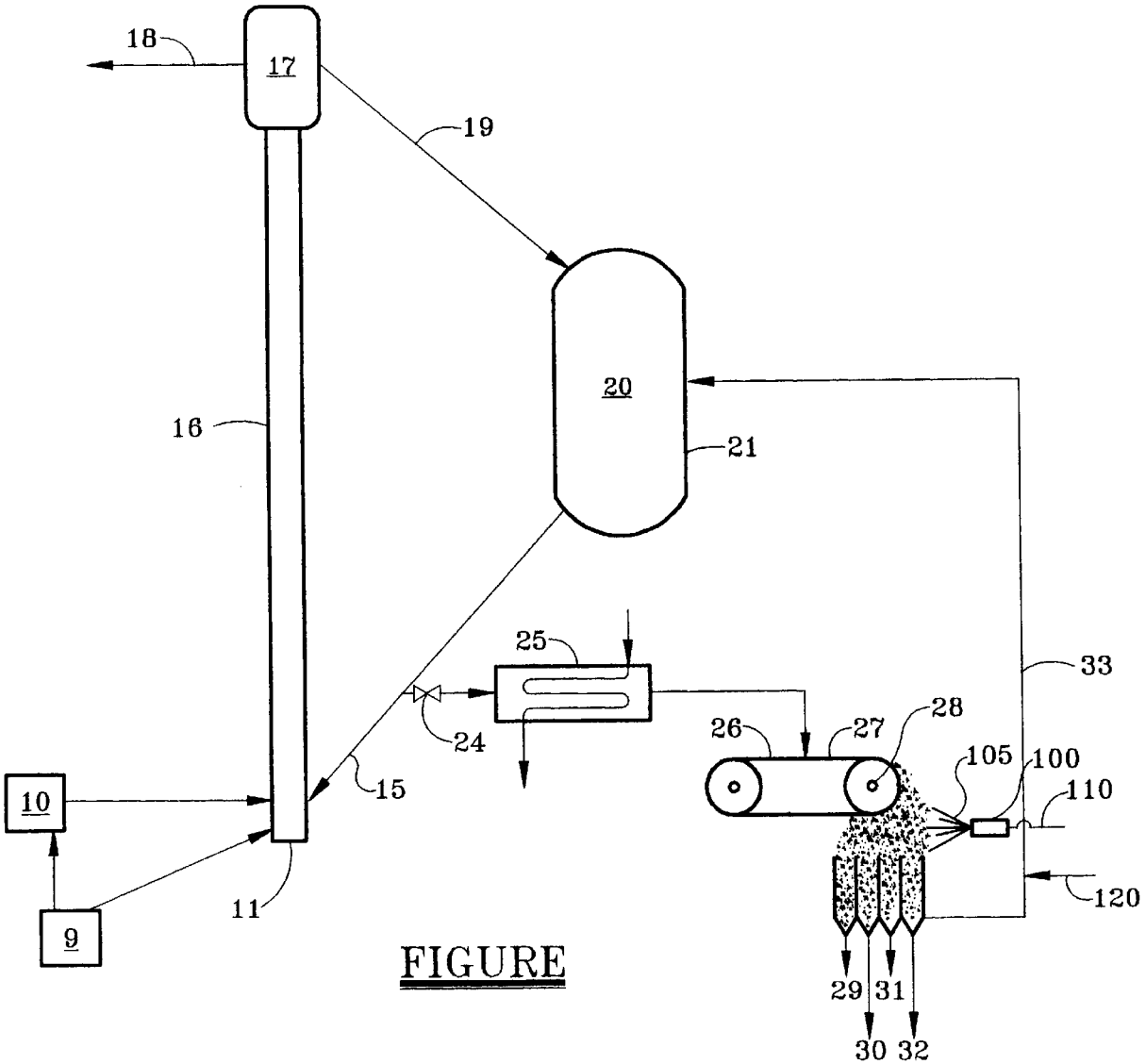
FIGURE

FCC METALS PASSIVATION ADDITIVES APPLIED TO CATALYST

CROSS REFERENCE TO RELATED APPLICATIONS

This application claims the benefit under 35 USC §119 of provisional application Ser. No. 60/052,335 filed Jul. 11, 1997.

FIELD OF THE INVENTION

This invention relates to catalyst and additives for the fluidized catalytic cracking process (FCC) and MagnaCat® magnetic separation of FCC equilibrium catalyst.

BACKGROUND OF THE INVENTION

Fluidized catalytic cracking (FCC) is well known and widely used for conversion of heavier feeds boiling in the gas oil and heavier range to lighter products including gasoline.

One of the problems encountered in FCC processing is that the heavy feeds processed contain metals, such as nickel and vanadium, which deposit on the circulating FCC catalyst. The deposited Ni+V act as catalyst poisons, promoting undesirable coke formation as well as excessive hydrogen and light gas formation.

Refiners have resorted to several tactics to avoid nickel and vanadium poisoning during FCC processing. The approaches could be arbitrarily classified three ways:

1. Keep Ni+V out of the FCC feed;
2. Leave Ni+V in the feed, but passivate or trap the metals once they reach the FCC catalyst; and
3. Allow Ni+V to deposit on the catalyst and use a magnetic separation process to remove the oldest, most metals-contaminated catalyst.

Approach no. 1, keeping the Ni+V out of the feed, has been used for over fifty years. The simplest and highly effective way to keep metals out is to distill the FCC feed. Distilled feeds are usually metals-free, or have such low metals levels that no special steps need to be taken to deal with Ni/V contamination. Distillation is simple, inexpensive, and widely used. One drawback is that distillation keeps significant amounts of potentially high value, readily convertible hydrocarbon out of the FCC unit. Phrased another way, if a refiner limits the feed to the FCC unit to distillable feeds, a lot of profit is left in the non-distillable, or residue fraction of the crude oil charged to the refinery. Solvent deasphalting of heavy feeds is effective at removing most metal contaminants from even non-distillable hydrocarbon feed. Deasphalted oil (DAO) can be charged to the FCC, with the asphalt fraction used for road construction, or sent to a coker. The drawback to this approach is the significant capital and the operating expense of operating a de-asphalting unit.

Most refiners are driven by economics to process some residual fractions in their FCC units and use approach no. 2, metals passivation. Thus, many FCC units now process feeds with a few weight percent resid up to 10 or 20 weight percent resid. With such feeds comes Ni and/or V catalyst contamination. One way to tolerate higher metals levels on FCC equilibrium catalyst is to passivate the deposited contaminating metals. Although many metal passivators are known, an especially effective and widely used passivator is antimony.

Metals passivation, usually by antimony addition, is probably the most popular method in the world for solving the problem of heavy metals in feeds. There are some drawbacks to use of Sb for metals passivation. Antimony is expensive, potentially toxic, and fugacious. It is difficult to run an accurate antimony balance around a typical FCC unit. Some of the antimony is believed to deposit on the walls of fired heaters, or perhaps on other solid surfaces within the FCC unit. There is enough problem with such deposits that U.S. Pat. No. 4,167,471 was granted on the discovery that adding the antimony compound after the FCC feed heater, rather than before, increased the amount of antimony that ended up on the catalyst.

Even with antimony injection after the FCC feed preheater, much of the antimony addition has been difficult to trace. Because of difficulties with Sb addition, refiners are now considering approach no. 3, magnetic beneficiation. The third method of dealing with excessive amounts of Ni and/or V in the FCC feed is to use the MagnaCat® magnetic catalyst separation process developed by Ashland Petroleum Company, Refining Process Services and the M.W. Kellogg Company. More details of this process are disclosed in one or more of the following patents:

U.S. Pat. No. 4,406,773 discloses magnetic separation of high activity catalyst from low activity catalyst.

U.S. Pat. No. 5,106,486 (Re. 35,046) teaches adding iron compound continuously or periodically to the circulating catalyst.

U.S. Pat. No. 5,147,527 covers the concept of using a magnetic rare earth roller device (RERMS) for magnetic separation.

U.S. Pat. No. 5,171,424 teaches the use of highly paramagnetic heavy rare earths as Magnetic Hook™ additives that increase catalyst performance.

U.S. Pat. No. 5,190,635 teaches accumulation of iron on the catalyst and formation of superparamagnetic or ferromagnetic species.

U.S. Pat. No. 5,230,869 covers the discovery of a highly superparamagnetic species, which when present in aged equilibrium catalyst, further improves separation due to its high magnetic susceptibility compared to normal paramagnetic iron.

U.S. Pat. No. 5,328,594 teaches use of heavy rare earths as Magnetic Hook™ additives.

U.S. Pat. No. 5,364,827 teaches adding amounts of magnetically active moieties, over time, so the moiety deposits on catalyst or sorbent in an FCC unit or similar circulating hydrocarbon conversion unit which can be separated from catalyst which has been in the system a shorter time.

U.S. Pat. No. 5,393,412 teaches a catalyst recovery unit ancillary to an FCC or similar unit, which permits magnetic separation, sieving and attriting of equilibrium catalyst.

U.S. Pat. No. 5,538,624 teaches retaining specialty additives by doping them with lots of magnetic metals.

SUMMARY OF THE INVENTION

We have discovered a better way to add additives such as antimony and Magnetic Hook™ additives to an FCC unit with a magnetic catalyst separation unit. We discovered that we could significantly increase the efficiency of a catalyst additive by employing one, and preferably two, mechanisms around the magnetic separation unit.

The primary mechanism for increased retention of liquid additive on FCC catalyst is believed to be regenerating the catalyst to produce clean, regenerated catalyst, then cooling below 500° F., and then spraying the cooled catalyst with a solution, preferably a fine mist of an aqueous solution, containing the desired additive. Ideally, the cooled, treated, catalyst is then sent back to the catalyst regenerator to, in effect, calcine the additive and fix it more permanently on the equilibrium catalyst.

Another mechanism for improving additive addition is to cool the catalyst, pass it through a magnetic separation unit, such as a MagnaCat®, and add additive only to that portion of the catalyst destined for recycle to the FCC unit. If 10 tons/day of equilibrium catalyst are charged to the magnetic separation unit, with 2 tons/day rejected to landfill, the additive would be applied exclusively to the 8 tons/day recycle fraction, with none applied to the reject fraction.

The effect of these two approaches is cumulative. In the case of a 20/80 reject/recycle magnetic separation process, spraying a manganese compound on the recycle fraction, rather than the total fraction, increases the apparent effectiveness of the manganese by 25%.

Because addition of an aqueous solution of additives, e.g., antimony to cooled, regenerated equilibrium catalyst is roughly 90 to 100% efficient, as compared to perhaps 50% efficient when added to the FCC feed upstream of the FCC preheater, the apparent effectiveness of antimony injection is roughly doubled.

A refiner using our approach to manganese or antimony addition could make from roughly 2 to 2.5 times better use of the manganese or antimony, as compared to prior art injection methods involving adding it to the FCC feed.

Accordingly, in one aspect, the present invention provides an improvement in a fluidized catalytic cracking (FCC) process with a circulating inventory of equilibrium catalyst passing from a cracking reactor wherein hydrocarbon feed is cracked to produce lighter catalytically cracked products and spent catalyst, and spent catalyst is regenerated in a catalyst regenerator at catalyst regeneration conditions to produce regenerated catalyst at a temperature of 1200 to 1600° F. which is recycled to the cracking reactor. The improvement comprises: (a) removing a portion of the regenerated catalyst from the catalyst regenerator; (b) cooling the regenerated catalyst in a catalyst cooler to produce cooled catalyst; (c) adding to the cooled catalyst a solution of an additive material in an amount less than or equal to the amount of liquid needed for an incipient wetness impregnation to produce additive-impregnated catalyst; and (d) recycling to the cracking reaction at least a portion of the additive-impregnated catalyst. The catalyst is preferably cooled to a temperature below 500° F., more preferably to a temperature below 300° F. Preferably, the regenerated catalyst has a spectrum of metals levels, including higher and lower metals levels, and the cooled catalyst is charged to a magnetic catalyst separator to produce a higher metals reject fraction which is discarded and a lower metals reject fraction, wherein the additive solution is added to the lower metals recycle fraction. The additive material can comprise a metals passivation additive, a magnetic hook material, or the like. The metals passivation additive preferably comprises antimony, more preferably an oxide of antimony, especially in an aqueous solution. The additive solution can also comprise a magnetic hook, in which case the recycle fraction has a relatively low magnetic susceptibility, but after treatment with the magnetic hook, the recycle fraction has an increased magnetic susceptibility. Other passivation elements which can be included in the solution include tin, manganese, bismuth and the like.

In another aspect, the present invention provides a fluidized catalyst cracking (FCC) process with a circulating inventory of equilibrium catalyst passing from a reactor wherein hydrocarbon feed is cracked to produce lighter catalytically cracked products and spent catalyst which is regenerated in a catalyst regenerator at catalyst regeneration conditions to produce hot regenerated FCC catalyst which is recycled to the cracking reactor. The process comprises the steps of: (a) removing a portion of regenerated catalyst from the catalyst regenerator; (b) cooling the removed catalyst in a catalyst cooler to produce cooled catalyst; (c) magnetically separating the cooled catalyst into at least one high magnetic susceptibility fraction and at least one lower magnetic susceptibility fraction; (d) removing from the FCC process at least one high magnetic susceptibility fraction; (e) contacting a lower magnetic susceptibility fraction with a solution of an additive material in an amount up to the amount of liquid needed for incipient wetness impregnation of the low magnetic susceptibility fraction to produce a free-flowing, fluidized treated catalytic fraction; and (f) recycling to the catalytic cracking unit at least a portion of the treated catalyst.

In a further aspect, the present invention provides an apparatus for the fluidized catalytic cracking of a hydrocarbon feed. The apparatus includes (a) a reactor for contacting the hydrocarbon feed with a source of hot regenerated catalyst from a catalyst regenerator; (b) a magnetic catalyst separation unit operatively associated with the regenerator for producing a high magnetic susceptibility fraction which is rejected from the catalytic cracking unit and a lower magnetic susceptibility fraction; and (c) an additive incorporation means for receiving the lower magnetic susceptibility fraction from the magnetic catalyst separation unit, comprising means for incorporating an additive solution onto the lower magnetic susceptibility fraction and means for recycling the resulting treated fraction to the regenerator.

BRIEF DESCRIPTION OF THE DRAWING

The FIGURE is a schematic diagram of an FCC unit and a magnetic catalyst separation unit according to the principles of the present invention.

DETAILED DESCRIPTION OF THE INVENTION

Bottoms 10 derived from distilling off a portion of crude oil enters the riser reactor 16 at 11. In the riser 16 the reduced crude contacts regenerated catalyst returning from the regenerator via line 15 and travels up the riser 16 cracking the reduced crude. Separator 17 produces product in line 18 and spent catalyst in line 19 which is contaminated with coke and metals from the reduced crude. The spent catalyst from line 19 enters the regenerator 20 and is oxidized with air via line 21 to burn off coke and thereby regenerate the catalyst for return to the riser 16 via line 15. About 8% of the regenerated catalyst is diverted through line 24 to catalyst cooler 25 and to feed to magnetic separator 26, where it falls onto belt 27, moves past roller 28, a high intensity rare earth-containing permanent magnetic roller which splits the catalyst into two or more portions 29 to 32. More magnetic portions, e.g. 29, and/or 29 and 30 are rejected for chemical reclaiming, metals recovery, or disposal. The less magnetic (less metal-contaminated) portions 31 and/or 31 and 32 travel through line 33 back to the regenerator 20. Manganese additive 9 may be a Magnetic Hook™ additive either added in amounts of 0.1 to 100 ppm to the feedstock in an organic solvent or water at 10 or on the catalyst at the bottom of the riser 11 prior to catalyst contact with oil, if desired.

In the present process, we spray on a solution of a catalyst additive material after cooling the catalyst in catalyst cooler 25 but before recycle of the catalyst regenerator 20. Metals passivating additive is preferably sprayed onto the recycle catalyst fraction via nozzle 100, receiving Sb solution from line 110 and discharging a finely atomized spray 105 onto the recycle fraction. Additive may also be added via injection means 120.

If desired, additive may be sprayed directly onto catalyst onto belt 27 or via one or more sprayers associated with one of the collection bins used to collect catalyst for recycle to the FCC unit. It is also possible to directly inject additive solution into the line transporting catalyst back to regenerator 20.

Regardless of where additive solution is added, it preferably is added in a controlled manner so that clumping or sticking of the catalyst does not occur.

The process and apparatus of the present invention provide a unique and better way to add soluble additives to FCC catalyst.

Preferably the additive is an antimony compound, most preferably an aqueous solution of an antimony compound. Reference is made to the following patents on antimony addition to provide more details on suitable antimony compounds and the amounts of antimony that should be added: U.S. Pat. No. 4,167,471; U.S. Pat. No. 4,255,287; U.S. Pat. No. 4,562,167; and U.S. Pat. No. 5,378,349.

The amount of antimony or additive present on catalyst in our process will be essentially the same as the amount of antimony needed on catalyst in prior art processes.

In addition to conventional metal passivation agents, such as antimony, it is also possible to add other materials using the process and apparatus of the present invention. Magnetic Hooks™ additive may be efficiently added using our invention. Some Magnetic Hooks™ additives also function as acidity enhancing additives, so that manganese may be added as a magnetic hook or for its ability to enhance activity, provide more resistance to deactivation, increase conversion and reduce coke and hydrogen yields, all as discussed in U.S. Pat. No. 5,198,098. Other additives which can be added to the catalyst according to the present invention include water soluble compounds of tin, manganese, bismuth and the like. Carbon monoxide combustion additives, such as an aqueous solution of a platinum compound, can also be sprayed onto the catalyst using the apparatus of the present invention. The apparatus can also be used to increase the rare earth content of the catalyst to improve steam stability of the zeolites, or as a Magnetic Hook™ additive. The process can also be used to add known, or yet to be developed, additives for control of $NO_x$, $SO_x$, and the like.

It is essential to remove the catalyst from the regenerator and cool it before contacting the regenerated catalyst with any additive. Preferably the catalyst is cooled more than 100° F., more preferably cooled to a temperature in the range of 200–300° F. This temperature is high enough to promote rapid vaporization of the solvent in the additive solution, but not so high as to prevent good contacting of the additive solution with the catalyst surface. If the catalyst surface temperature is too high, there may be impaired contacting of liquid/catalyst, much as water never wets the surface of a frying pan which is too hot.

It is preferable to have a certain minimum temperature, otherwise the catalyst can easily form clumps when any liquid droplets that are oversized are inadvertently sprayed on the catalyst. We try never to have a stable liquid phase in our process. It may seem a little unusual to call for catalyst "impregnation" when the catalyst temperature at the start of the process at least is preferably above the boiling point of water, but that is preferred to minimize fluid handling problems.

EXAMPLES

A number of experiments were performed in our laboratories to determine the validity of this processing concept. The examples did not include magnetic separation in order that the test procedure might be simplified. The test also represents an upper limit on use of additive solution, i.e. an incipient wetness procedure was used. In practice we would probably use less impregnating solution to avoid formation of clumps or sticky masses of water-soaked catalyst.

EXAMPLE 1

The catalyst tested was a 50/50 blend of two commercially available catalysts available under the trade designations RAMCAT and NOVA which had been steamed and metallated using our standard procedures. The additive used was an aqueous solution of antimony pentoxide, methanol, ethylene glycol and amines obtained commercially as NALCO 5006. The antimony content was measured to be 21 weight percent. There were three sets of runs made each in duplicate: conventional metals addition, spray-on-metals addition, and baseline with no metals addition. The additive was added at a target ratio of 0.5/1 Sb/Ni by weight. The nickel content of the catalyst was 1400 ppm.

Baseline—No Metals Addition

Three cycles were run. Each cycle was run with 188 g of feed and 564 g of catalyst without an antimony addition for a catalyst/oil ratio of 3.0.

Conventional Metals Additive Addition

The conventionally added antimony additive was added to the feed in three cycles. Each cycle was run with 188 g of FCC feed with 564 g of catalyst blend.

Spray-On Metals Additive Addition

The antimony additive was diluted with water and sprayed onto the catalyst with a hand operated plastic spray bottle. The catalyst (800 g) was put into a ceramic crucible while it was sprayed with the additive solution. The additive (2.67 g) was diluted with the calculated amount of water to get the catalyst to incipient wetness (pore volume times the amount of catalyst ((0.32 ml/g)*(800 g=256 cc)). The sprayed on catalyst was then calcined in air at 1100° F. for four hours. The antimony laden catalyst was then run for three cycles. Each cycle was run with 188 g of FCC feed with 564 g of catalyst blend for a catalyst/oil ratio of 3.0.

Catalyst samples obtained from each of the methods were analyzed for metals and microactivity test (MAT) analysis. The results are presented in Table 1

TABLE 1

| Property | No Additive | Additive In Feedstock | Sprayed On Additive |
|---|---|---|---|
| MAT (vol %) | 76 | 76 | 78 |
| Hydrogen Factor | 10.0 | 9.9 | 6.7 |
| Antimony (wt %) | <0.01 | 0.02 | 0.09 |
| Nickel (wt %) | 0.14 | 0.13 | 0.15 |
| Sb/Ni Ratio | <0.07 | 0.15 | 0.60 |

EXAMPLE 2

The procedures of Example 1 were repeated using a 100% NOVA catalyst. The results are presented in Table 2.

TABLE 2

| Property | No Additive | Additive In Feedstock | Sprayed On Additive |
|---|---|---|---|
| MAT (vol %) | 76 | 75 | 76 |
| Hydrogen Factor | 10.0 | 8.8 | 6.2 |
| Antimony (wt %) | <0.01 | 0.024 | 0.1 |
| Nickel (wt %) | 0.14 | 0.13 | 0.14 |
| Sb/Ni Ratio | <0.07 | 0.16 | 0.71 |

The above data show that antimony was effective at reducing hydrogen yield, and was nearly an order of magnitude better when added as a spray onto the catalyst than when introduced with the hydrocarbon feedstock. Antimony appears to be effective only if it deposits on the catalyst; the decrease in hydrogen yield is directly proportional to the amount of antimony deposited on the catalyst. Adding antimony with the feedstock resulted in consistently low antimony recoveries, but quite surprisingly, nearly all of the antimony was recovered when sprayed as a mist onto the catalyst.

We claim:

1. In a fluidized catalytic cracking (FCC) process with a circulating inventory of equilibrium catalyst passing from a cracking reactor wherein hydrocarbon feed is cracked to produce lighter catalytically cracked products and spent catalyst is regenerated in a catalyst regenerator at catalyst regeneration conditions to produce regenerated catalyst at a temperature of 1200 to 1600° F. which is recycled to the cracking reactor, the improvement comprising:

(a) removing a portion of the regenerated catalyst from the catalyst regenerator;

(b) cooling the regenerated catalyst in a catalyst cooler to produce cooled catalyst;

(c) adding to the cooled catalyst a solution of an additive material which comprises antimony in an amount less than or equal to the amount of liquid needed for incipient wetness impregnation to produce additive-impregnated catalyst;

(d) recycling to the cracking reactor at least a portion of the additive impregnated catalyst.

2. The improvement of claim 1 wherein said catalyst is cooled in step (b) to a temperature below 500° F.

3. The improvement of claim 1 wherein said catalyst is cooled in step (b) to a temperature below 300° F.

4. The improvement of claim 1 wherein said regenerated catalyst has a spectrum of metals levels, including higher and lower metals levels and cooled catalyst is charged to a magnetic catalyst separator to produce a higher metals reject fraction which is discarded and a lower metals recycle fraction, and wherein the solution is added to the lower metals recycle fraction.

5. The improvement of claim 1 wherein the additive is an oxide of antimony.

6. The improvement of claim 1 wherein the additive is an aqueous solution.

7. In a fluidized catalytic cracking (FCC) process with a circulating inventory of equilibrium catalyst passing from a reactor wherein hydrocarbon feed is cracked to produce lighter, catalytically cracked products and spent catalyst, which is regenerated in a catalyst regenerator at catalyst regeneration conditions to produce hot regenerated FCC catalyst which is recycled to the cracking reactor comprising:

(a) removing a portion of regenerated catalyst from the catalyst regenerator;

(b) cooling the removed catalyst in a catalyst cooler to produce cooled catalyst;

(c) magnetically separating the cooled catalyst into at least one high magnetic susceptibility fraction and at least one lower magnetic susceptibility fraction;

(d) removing from said FCC process at least one high magnetic susceptibility fraction;

(e) contacting a lower magnetic susceptibility fraction with a solution of metals passivation additive material which comprises an antimony compound in an amount up to the amount of liquid needed for incipient wetness impregnation of said low magnetic susceptibility fraction to produce a free-flowing fluidized treated catalyst fraction;

(f) recycling to said catalytic cracking unit at least a portion of said treated catalyst.

8. The process of claim 7 wherein the cooling step (b) cools the catalyst to below 300° F.

9. The process of claim 7 wherein the antimony compound is a soluble oxide.

* * * * *